US008714927B1

(12) United States Patent
Jenne et al.

(10) Patent No.: US 8,714,927 B1
(45) Date of Patent: May 6, 2014

(54) MICROCIRCUIT SKIN CORE CUT BACK TO REDUCE MICROCIRCUIT TRAILING EDGE STRESSES

(75) Inventors: Douglas C. Jenne, West Hartford, CT (US); Matthew S. Gleiner, Vernon, CT (US); Matthew A. Devore, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 470 days.

(21) Appl. No.: 13/180,819

(22) Filed: Jul. 12, 2011

(51) Int. Cl.
*F01D 5/18* (2006.01)

(52) U.S. Cl.
USPC ..... 416/97 R

(58) Field of Classification Search
USPC ..... 415/115, 116; 416/96 R, 97 R
See application file for complete search history.

(56) References Cited

U.S. PATENT DOCUMENTS 5,368,441 A 11/1994 Sylvestro et al.
6,126,397 A * 10/2000 Kvasnak et al. ..... 416/97 R
6,520,836 B2 2/2003 Dean
6,974,308 B2 * 12/2005 Halfmann et al. ..... 416/97 R
7,438,527 B2 10/2008 Albert et al.
7,717,676 B2 * 5/2010 Cunha et al. ..... 416/97 R
7,845,906 B2 * 12/2010 Spangler et al. ..... 416/97 R
2008/0175714 A1 7/2008 Spangler et al.
2010/0129195 A1 * 5/2010 Surace et al. ..... 415/115

FOREIGN PATENT DOCUMENTS

EP 1790823 A2 5/2007
EP 1813774 A2 8/2007
EP 2193859 A1 6/2010

* cited by examiner

*Primary Examiner* — Edward Look
*Assistant Examiner* — Liam McDowell
(74) *Attorney, Agent, or Firm* — Bachman & LaPointe, P.C.

(57) ABSTRACT

A casting system for forming an airfoil portion of a turbine engine component is provided. The casting system includes a main body core for forming at least one internal cavity in the airfoil portion, a microcircuit skin core for forming a cooling microcircuit embedded in a wall of the airfoil portion, and a trailing edge core for forming a cooling passage in a trailing edge of the airfoil portion. The microcircuit skin core has at least one cut-back portion which is sized so as to provide said cooling microcircuit embedded in the wall with a length which allows heat-up of the trailing edge core from a gas path.

12 Claims, 6 Drawing Sheets

MICROCIRCUIT SKIN CORE CUT BACK TO REDUCE MICROCIRCUIT TRAILING EDGE STRESSES

STATEMENT OF GOVERNMENT INTEREST

The subject matter described herein was made with government support under Contract No. F33615-03-D-2354-0009 awarded by the Department of the Air Force. The government of the United States of America may have rights to the subject matter described herein.

BACKGROUND

The present disclosure relates to a core system for use in casting an airfoil portion of a turbine engine component.

High heat load applications for turbine engine components require intermediate wall cores (microcircuits) which are embedded between a main body core and an external surface of a turbine airfoil to provide cooling and shielding from coolant heat pick up. In providing such systems in the past, unwanted thermal stresses have been created.

SUMMARY

In accordance with the instant disclosure, there is provided a casting system for forming an airfoil portion of a turbine engine component. The casting system broadly comprises a main body core for forming at least one internal cavity in said airfoil portion, a microcircuit skin core for forming a cooling microcircuit embedded in a wall of said airfoil portion, a trailing edge core for forming a passage in a trailing edge of said airfoil portion, and said microcircuit skin core having at least one cut-back portion which is sized so as to provide said cooling microcircuit embedded in said wall with a length which allows heat-up of the trailing edge core from a gas path.

It has been found by the inventors that full body microcircuits are needed to cool portions of highly heat loaded turbine components. In additional embodiments, the present disclosure shows how to locally remove the microcircuit skin core and/or microcircuit trailing edge pedestals to reduce thermal gradients across the region of the part.

Further in accordance with the present disclosure, there is provided a turbine engine component having an airfoil portion. The airfoil portion has an internal cavity through which cooling air flows, a cooling microcircuit embedded in a wall, said cooling microcircuit receiving cooling air from said internal cavity, a trailing edge core having an inlet region, and said cooling microcircuit embedded in said wall having an exit end which terminates at said inlet region of said trailing edge core so as to expose said trailing edge cooling microcircuit to heat-up from a gas path following adjacent a surface of said wall.

Other details of the microcircuit skin core cut back to reduce microcircuit trailing edge stresses are set forth in the following detailed description and the accompanying drawings wherein like reference numerals depict like elements.

DETAILED DESCRIPTION OF THE PREFERRED EMBODIMENT(S)

Figure 1:
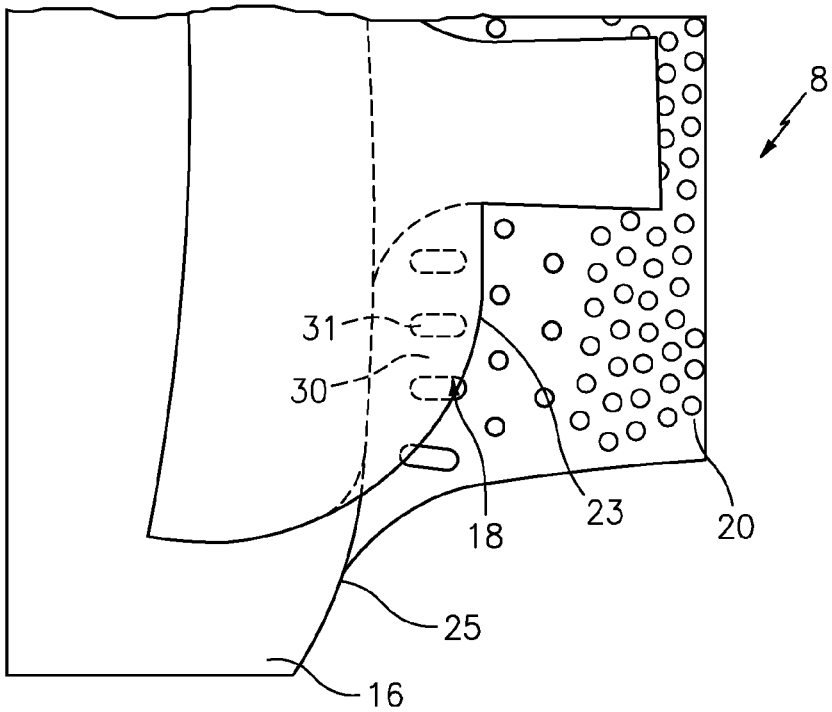
FIG. 1 is a schematic representation of a core arrangement for forming cooling microcircuits in an airfoil portion of a turbine engine component.
Figure 2:
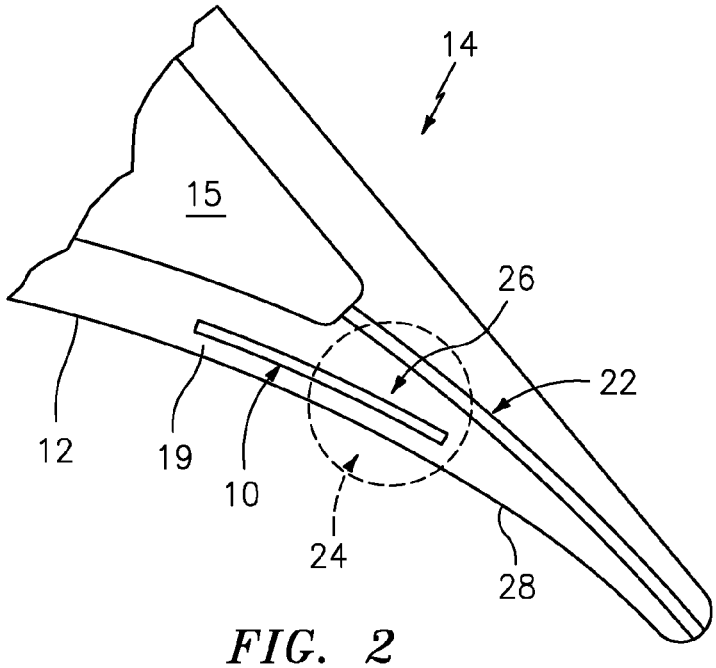
FIG. 2 illustrates a cross sectional view of an airfoil portion formed using the core arrangements of FIG. 1.

FIGS. 1 and 2 illustrate an arrangement 8 of cores which are used to form cooling microcircuits 10 and 22 in an airfoil portion 12 of a turbine engine component 14 such as a turbine blade. The core arrangement 8 includes at least one main body core 16, which may be formed from a ceramic material and which forms one or more central or internal passageways 15 within the airfoil portion 12, a microcircuit skin core 18, which may be formed from a refractory metal material and which forms the cooling microcircuit 10 embedded within a wall 19 of the airfoil portion 12, and a trailing edge core 20 which forms the trailing edge microcircuit 22, which trailing edge core 20 may be formed from a refractory metal or a ceramic material. Typically, the microcircuit skin core 18 is attached to the main body core 16 so that the trailing edge 23 of the core 18 overlaps the inlet of the trailing edge refractory metal core 25 of the main body core 16. As shown in FIG. 1, the overlap region 30 can cover features on the trailing edge core 20 such as the holes 31 used to form pedestals in the microcircuit 22. The trailing edge core 20 is also attached to the main body core 16. The microcircuit skin cores 18 and the trailing edge core 20 form a double wall construction shown in the circled area 24 in FIG. 2. As a result, there is a region of the trailing edge core 26 which is shielded from the pressure side gas path.

Microcircuit skin cores 18, such as that shown in FIG. 1, create the shielded region 26 of the trailing edge microcircuit 22. This is because in such designs, the microcircuit skin core 18 creates the double wall airfoil between the external skin surface 28 and the trailing edge microcircuit 22. Certain applications of such a microcircuit skin core 18 and a trailing edge microcircuit 22 can reveal high thermal gradients across the airfoil trailing edge shielded region 26 as a result of the double-wall airfoil construction in this region.

Figure 3:
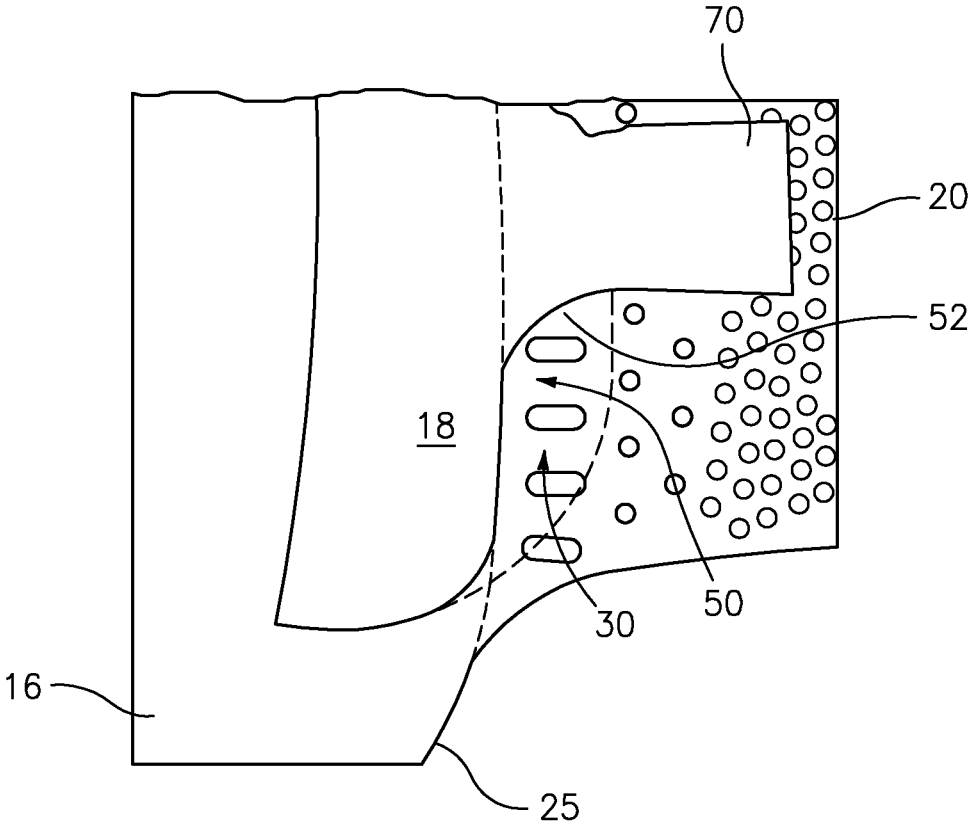
FIG. 3 is a schematic representation of another core arrangement for forming cooling microcircuits where the microcircuit skin core has a cut back region.
Figure 4:
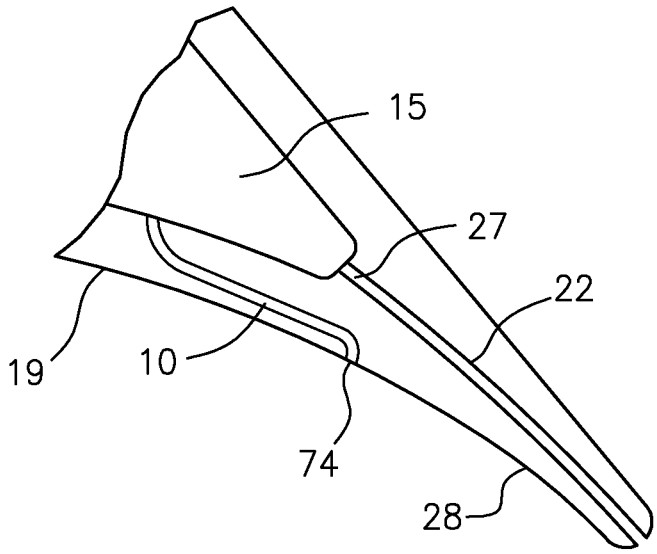
FIG. 4 illustrates a cross sectional view of an airfoil portion formed using the casting system of FIG. 3.

FIG. 3 shows an arrangement of cores to be used in a casting system for forming an airfoil portion of a turbine engine component. As shown in FIG. 4, it has been found that removal of the portion 30 of the microcircuit skin core 18 creates a cut-back portion directly adjacent to the inlet 27 of the trailing edge microcircuit 20. The cut-back portion 30 is sized so that the cooling microcircuit 10 formed by the core 18 allows heat-up of the trailing edge microcircuit 22 from external skin surface 28. By allowing the trailing edge microcircuit 22 to heat up, the high thermal gradients across the trailing edge shielded region 26 can be reduced. Reductions in thermal gradients across the trailing edge shielded region 26 reduce correspondingly thermally driven stresses and strains, by up to 42%.

As shown in FIGS. 3 and 4, the cutback microcircuit skin core 18 exposes the trailing edge microcircuit 20 to heat-up from the gas path. As can be seen by the circled area 24 in FIG.

2, a trailing edge shielded region 26 is not present, which exposes trailing edge microcircuit 22 to the pressure side gas path.

The cut-back portion(s) 30 may be located anywhere along the span of the airfoil. When cutting back the microcircuit skin core 18, the cut-back portion 30 may have a gradual blend area 52, such as in the form of a curved or an arcuate section, which leads to the portion 70 of the skin core which forms the fluid exit of the microcircuit 10 formed by the skin core 18. The gradual blend area 52 is desirable to insure a smooth flow of fluid in the final microcircuit 10. As can be seen from FIG. 3, the portion 70 may overlap the portion of the trailing edge core 20 forming the inlet region of the trailing edge microcircuit 22 in a chordwise direction. At least one cut-back portion 50 of the skin core 18 may be found in the region where the platform of the turbine engine component would be formed.

As shown in FIG. 3, the cut back microcircuit skin core 18 maybe cut-back to expose the holes that form the pedestals within the trailing edge microcircuit 22. The skin core 18 is provided with a trailing edge 40 which does not extend beyond the trailing edge 25 of the main body core 16.

Figure 5:
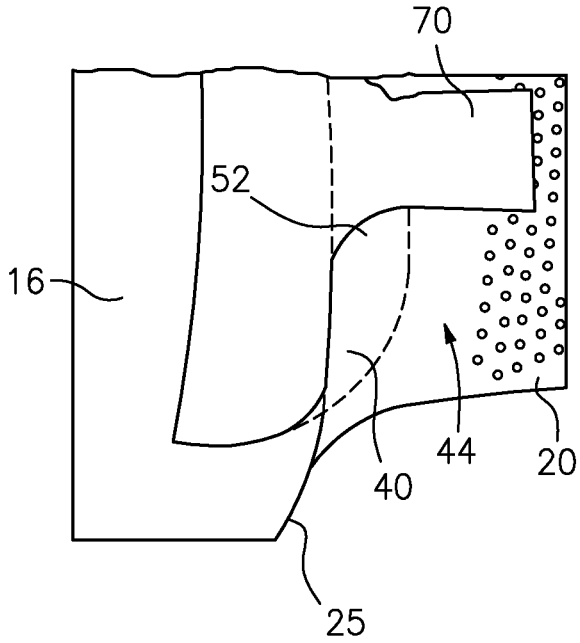
FIG. 5 illustrates an alternative microcircuit skin core.

FIG. 5 shows another embodiment wherein the cut-back microcircuit skin core 18, in addition to having a trailing edge 40 which does not extend beyond the trailing edge 25 of the main body core 16, has no pedestals in an inlet region 44 of the trailing edge core 20.

Figure 6:
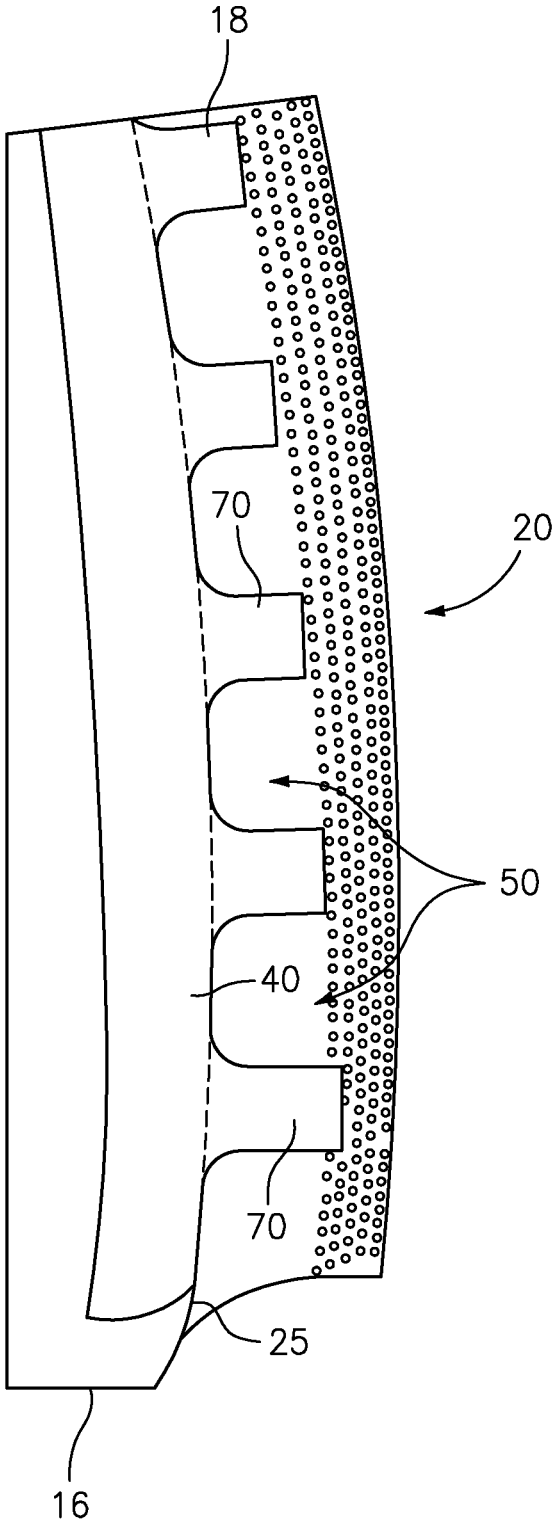
FIG. 6 illustrates a microcircuit skin core having a plurality of cut back portions.

FIG. 6 shows an embodiment where the cut-back microcircuit skin core 18 has a plurality of cut-back portions 50 which extend along the span of the skin core 18. As in other configurations, the trailing edge 40 of the microcircuit skin core 18 does not extend beyond the trailing edge 25 of the main body core 16. An advantage to this configuration is that it exposes more of the shielded region 26. As can be seen from FIG. 6 the core 18 may extend from a root region of the component to a tip of the component.

As shown in each of FIGS. 3, 5 and 6, the skin core 18 has a non-cut back region 70 which forms the exit for the cooling microcircuit 10. This non-cut back portion 70 extends beyond the trailing edge 25 of the main body core 16 and overlaps the inlet portion 44 of the trailing edge core 20.

As can be seen from FIG. 4, using the casting system of the present invention, one is able to form a cooling microcircuit 10 which is connected to an internal cavity 15 through which cooling air flows and which has an exit end 74 which terminates at the external skin surface 28.

Figure 8:
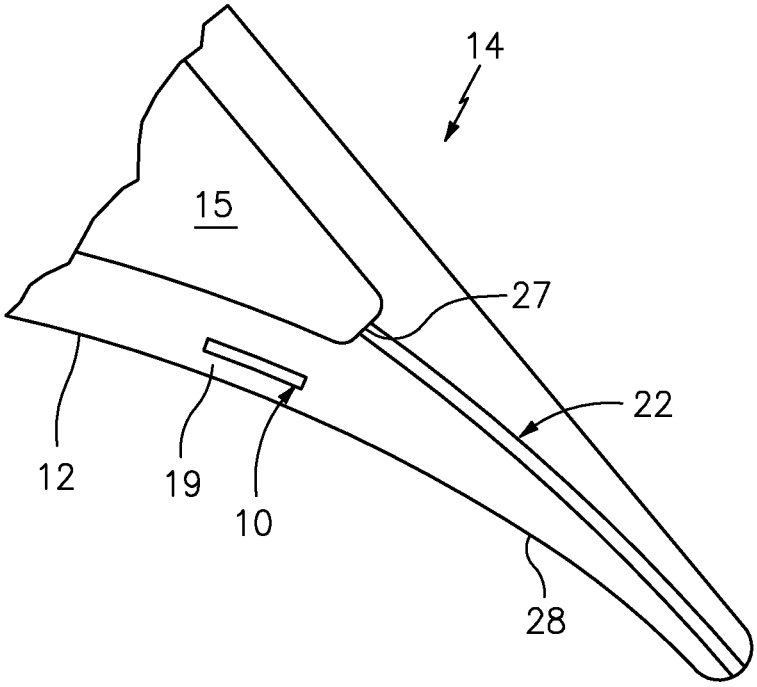
FIG. 8 is a sectional view of an airfoil.

Referring now to FIG. 8, the cooling microcircuit 10 has a length so that it only overlaps an inlet region 27 of the trailing edge microcircuit 22 and terminates in a chordwise manner at said inlet region. As a result, the trailing edge microcircuit 22 is exposed to heat-up from the gas path which flows along the surface 28 of the wall in which the cooling microcircuit 10 is embedded. The effect of this arrangement is that thermal stresses are decreased in the trailing edge region.

Figure 7:
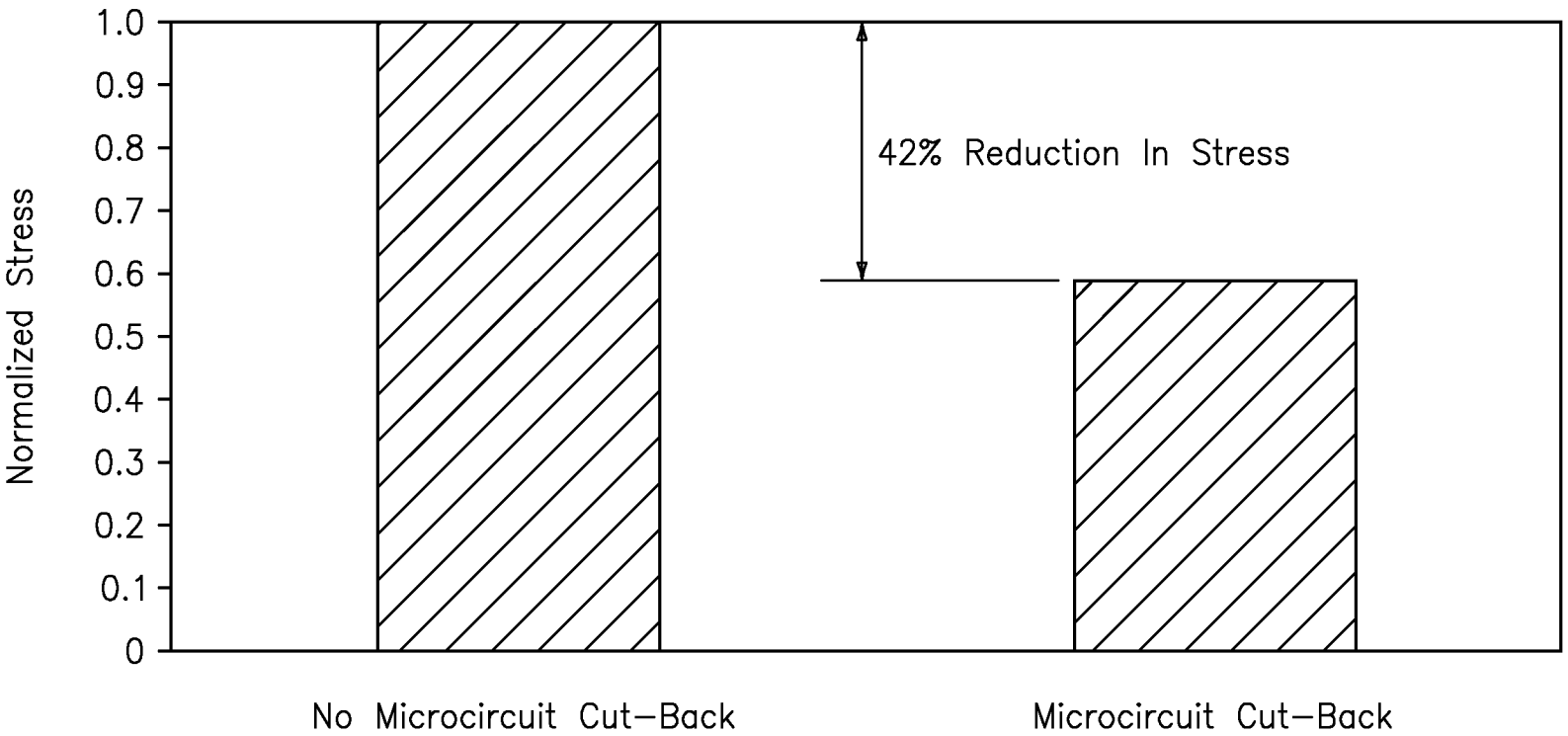
FIG. 7 is a graph showing the reduction in stress which occurs by using the microcircuit skin cores described herein.

A test of a microcircuit without the cutback and a microcircuit with a cut-back as described hereinabove was conducted to determine the percent reduction in stress caused by the microcircuit design of the present disclosure. As shown in FIG. 7, a 42% reduction in stress was obtained.

As can be seen from the foregoing discussion, the microcircuit core system with the cut-back microcircuit skin core 18 described hereinabove reduces the thermal gradients between the microcircuit skin core 18 and the microcircuit trailing edge 22. Thermal gradients are reduced, thereby the thermal stresses are also reduced. As stresses are reduced, the fatigue capability is increased.

There has been described herein a microcircuit skin core cut back to reduce microcircuit trailing edge stresses. While the microcircuit skin core has been described in the context of specific embodiments thereof, other unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. A casting system for forming an airfoil portion of a turbine engine component, said system comprising:

a main body core for forming at least one internal cavity in said airfoil portion;

a microcircuit skin core for forming a cooling microcircuit embedded in a wall of said airfoil portion;

a trailing edge core for forming a cooling passage in a trailing edge of said airfoil portion; and said microcircuit skin core having at least one cut-back portion which is sized so as to provide said cooling microcircuit embedded in said wall with a length which allows heat-up of the trailing edge core from a gas path.

2. The casting system according to claim 1, wherein said trailing edge core has a portion that forms an inlet region for said trailing edge core which includes a plurality of holes for forming pedestals within said trailing edge core and said at least one cut-back portion having a trailing edge which does not overlap any of said pedestal forming holes.

3. The casting system according to claim 1, wherein said main body core has a trailing edge and said at least one cut-back portion does not extend beyond the trailing edge of said main body core.

4. The casting system according to claim 1, wherein said microcircuit skin core has a plurality of cut-back portions extending in a spanwise direction.

5. The casting system according to claim 4, wherein one of said cut-back portions is located in an area where a platform is to be formed.

6. The casting system according to claim 1, wherein said microcircuit skin core has an end portion which forms an exit region in said cooling microcircuit in said wall and a curved blend region connecting said end portion with said cut-back portion.

7. The casting system according to claim 6, wherein said end portion is located between two cut-back portions and each of said cut-back portions is connected to said end portion by a curved blend region.

8. The casting system according to claim 6, wherein said end portion has a plurality of holes for forming pedestals in the exit region in said cooling microcircuit.

9. The casting system of claim 1, wherein said microcircuit skin core is formed from a refractory metal.

10. The casting system of claim 9, wherein said main body core is formed from a ceramic material and said trailing edge core is formed from one of a refractory metal and a ceramic material.

11. The casting system of claim 1, wherein said trailing edge core has an inlet region without any holes and said cut-back portion does not overlap said inlet region.

12. The casting system of claim 1, wherein a trailing edge of said cut-back portion overlaps an inlet region of said trailing edge core.

* * * * *